US008545666B2

(12) United States Patent
Grove

(10) Patent No.: US 8,545,666 B2
(45) Date of Patent: Oct. 1, 2013

(54) LABELING APPARATUS FOR APPLYING WRAP LABELS AND METHOD

(75) Inventor: Joseph A. Grove, Ducansville, PA (US)

(73) Assignee: Ossid LLC, Rocky Mount, NC (US)

( * ) Notice: Subject to any disclaimer, the term of this patent is extended or adjusted under 35 U.S.C. 154(b) by 1280 days.

(21) Appl. No.: 12/201,083

(22) Filed: Aug. 29, 2008

(65) Prior Publication Data

US 2009/0056872 A1 Mar. 5, 2009

Related U.S. Application Data

(60) Provisional application No. 60/969,001, filed on Aug. 30, 2007.

(51) Int. Cl.
*B65C 9/25* (2006.01)

(52) U.S. Cl.
USPC ..... 156/324; 156/249; 156/538

(58) Field of Classification Search
USPC ..... 156/249, 324, 538
See application file for complete search history.

(56) References Cited

U.S. PATENT DOCUMENTS 3,659,394 A * 5/1972 Hartleib et al. ..... 53/442
4,046,613 A * 9/1977 Kucheck et al. ..... 156/249
4,909,891 A * 3/1990 Sumi et al. ..... 156/497

* cited by examiner

*Primary Examiner* — Yogendra Gupta
*Assistant Examiner* — John Robitaille
(74) *Attorney, Agent, or Firm* — Thompson Hine LLP

(57) ABSTRACT

A labeling apparatus for applying wrap labels includes a first conveyor section and a second conveyor section aligned with the first conveyor section thereby defining a conveying surface along which a package is conveyed in a conveying direction. The first conveyor section is spaced from the second conveyor section in the conveying direction thereby defining a gap between the first conveyor section and the second conveyor section. A label conveyor is located at least partially below the conveying surface having a vertical orientation to deliver a wrap label upwardly through the gap between the first and second conveyor sections. A wiper assembly is located above and spaced vertically from the conveyor surface to define a space between the wiper assembly and the conveying surface. The wiper assembly is arranged to receive a leading edge of the wrap label when it is delivered from the label conveyor and to position the leading edge of the wrap label such that the wrap label spans the space between the wiper assembly and the conveying surface for delivery of an adhesive surface of the wrap label over an edge of the package as the package passes through the space.

16 Claims, 14 Drawing Sheets

LABELING APPARATUS FOR APPLYING WRAP LABELS AND METHOD

CROSS-REFERENCE TO RELATED APPLICATIONS

This application claims priority to U.S. Provisional Application No. 60/969,001, filed Aug. 30, 2007, the details of which are hereby incorporated by reference as if fully set forth herein.

TECHNICAL FIELD

The present application relates generally to labeling apparatus and more particularly to a labeling apparatus and associated method for applying a wrap label.

BACKGROUND

A wrap label may be adhered over an end of a package. Automated labeling systems are known for applying such wrap labels on packages.

SUMMARY

In an aspect, a labeling apparatus for applying wrap labels includes a first conveyor section and a second conveyor section aligned with the first conveyor section thereby defining a conveying surface along which a package is conveyed in a conveying direction. The first conveyor section is spaced from the second conveyor section in the conveying direction thereby defining a gap between the first conveyor section and the second conveyor section. A label conveyor is located at least partially below the conveying surface having a vertical orientation to deliver a wrap label upwardly through the gap between the first and second conveyor sections. A wiper assembly is located above and spaced vertically from the conveyor surface to define a space between the wiper assembly and the conveying surface. The wiper assembly is arranged to receive a leading edge of the wrap label when it is delivered from the label conveyor and to position the leading edge of the wrap label such that the wrap label spans the space between the wiper assembly and the conveying surface for delivery of an adhesive surface of the wrap label over an edge of the package as the package passes through the space.

In another aspect, a method for applying wrap labels is provided. The method includes using a label conveyor for delivering a leading edge of a wrap label through a gap formed between a first conveyor section and a second conveyor section aligned with the first conveyor section thereby defining a conveying surface along which a package is conveyed in a conveying direction. The first conveyor section is spaced from the second conveyor section in the conveying direction thereby defining the gap between the first conveyor section and the second conveyor section. The label conveyor is located at least partially below the conveying surface having a vertical orientation to deliver a upwardly through the gap between the first and second conveyor sections. The leading edge of the wrap label is located on a wiper assembly located above and spaced vertically from the conveyor surface to define a space between the wiper assembly and the conveying surface. The wiper assembly receives the leading edge of the wrap label when the leading edge is delivered from the label conveyor such that the wrap label spans the space between the wiper assembly and the conveying surface for delivery of an adhesive surface of the wrap label over an edge of the package as it passes through the space.

In another aspect, a labeling apparatus for applying wrap labels includes a first conveyor section and a second conveyor section aligned with the first conveyor section thereby defining a conveying surface along which a package is conveyed in a conveying direction. The first conveyor section is spaced from the second conveyor section in the conveying direction thereby defining a gap between the first conveyor section and the second conveyor section. A label conveyor is located at least partially below the conveying surface having a vertical orientation to deliver a wrap label upwardly through the gap between the first and second conveyor sections. A wiper assembly is located above and spaced vertically from the conveyor surface to define a space between the wiper assembly and the conveying surface. The wiper assembly includes a vacuum assembly configured to generate negative pressure to position a leading edge of the wrap label when it is delivered from the label conveyor such that the wrap label spans the space between the wiper assembly and the conveying surface for delivery of an adhesive surface of the wrap label over an edge of the package as the package passes through the space.

The details of one or more embodiments are set forth in the accompanying drawings and the description below. Other features, objects, and advantages will be apparent from the description and drawings.

DETAILED DESCRIPTION

Figure 1:
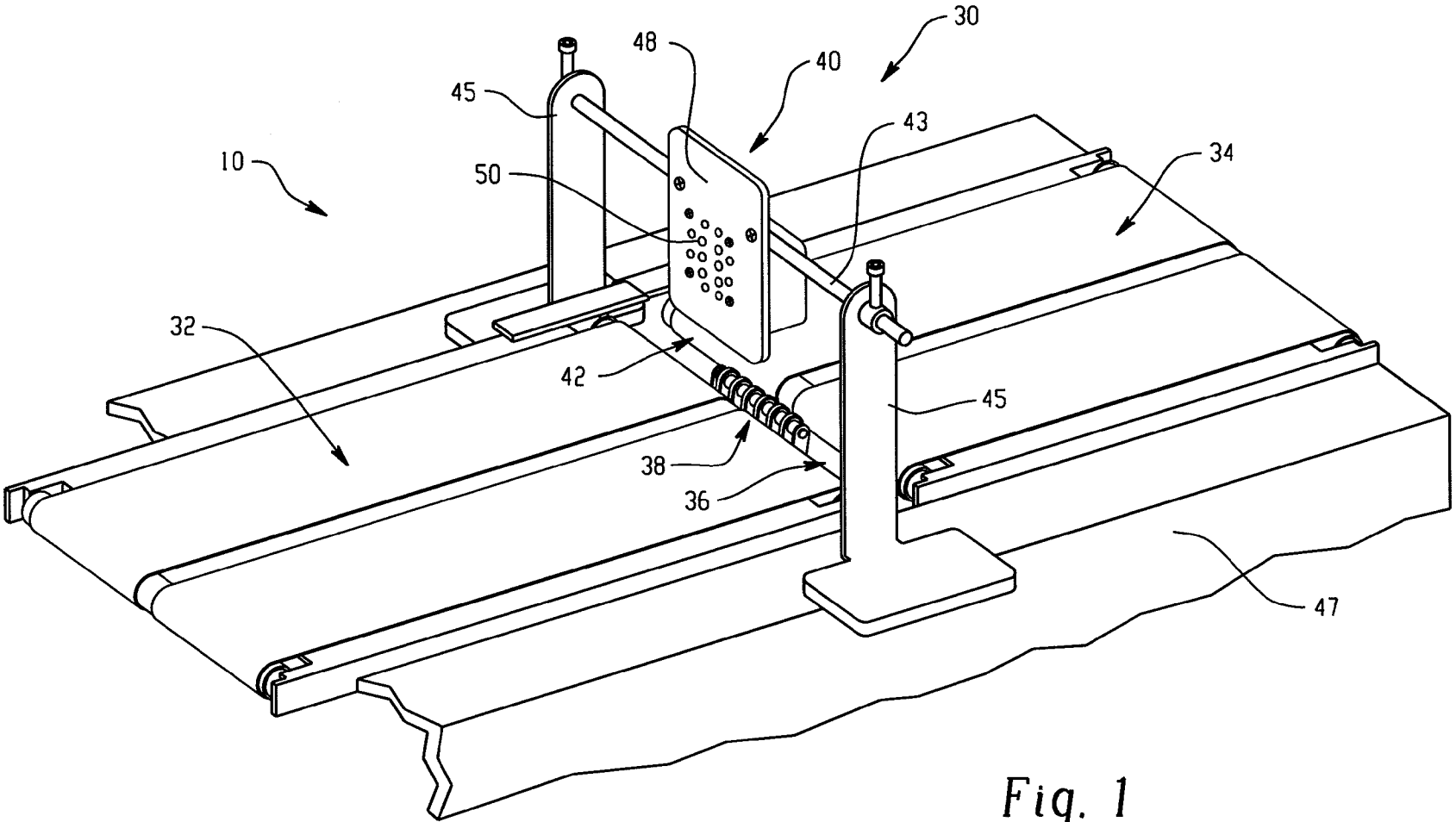
FIGS. 1, 3 and 4 are images of a labeling apparatus including an embodiment of a label applying section.

Referring to FIG. 1, a labeling apparatus 10 for applying wrap labels to packages is shown. As used herein, a "wrap label" is a label that is wrapped around an edge of a package such as a tray product, for example, containing a meat or other food product such as sandwiches, fruits, vegetables, etc., or non-food products. Such wrap labels may sometimes be referred to as clamshell labels. By "edge," we mean a location where surfaces meet. The term "edge" is also meant to include ends and corners of packaged products.

Figure 2:
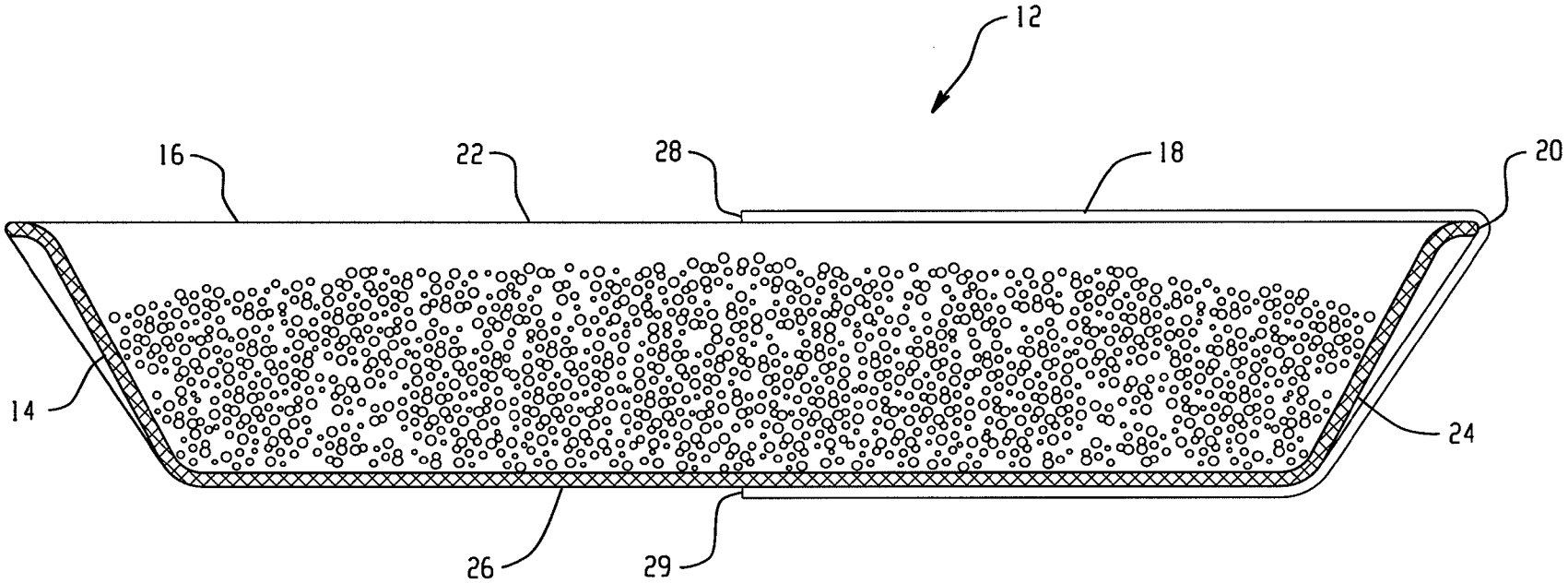
FIG. 2 is a diagrammatic side section view of an embodiment of a tray product including a wrap label.

Referring to FIG. 2, for example, a tray product 12 includes a tray portion 14, a film 16 (e.g., a stretch wrap or shrink wrap film) that is wrapped about the tray and product located therein, and a wrap label 18 that is wrapped about an edge 20 of the tray product, extending from a top surface 22, over a side surface 24 to a bottom surface 26 of the tray product. In some embodiments, the tray product 12 includes a lid (such as a clamshell-type container, e.g., without film 16) and the lid may provide an air-tight or other fluid-tight seal for isolating contents of the tray from the environment. One edge 28 of the wrap label 18 terminates on the top surface 22 of the tray product 12 and an opposite edge 29 terminates on the bottom surface 26 of the tray product at a location spaced-from the edge 28 without any overlap of the label. In some embodiments, the wrap label 18 may be formed of one or more layers, for example, of paper and/or plastic film material and includes a pressure-sensitive adhesive backing for adhering the label to surfaces of the tray product 12. The wrap label may also include a visible print layer that conveys information, such as a design, product origin, weight, price, date, etc.

Figure 3:
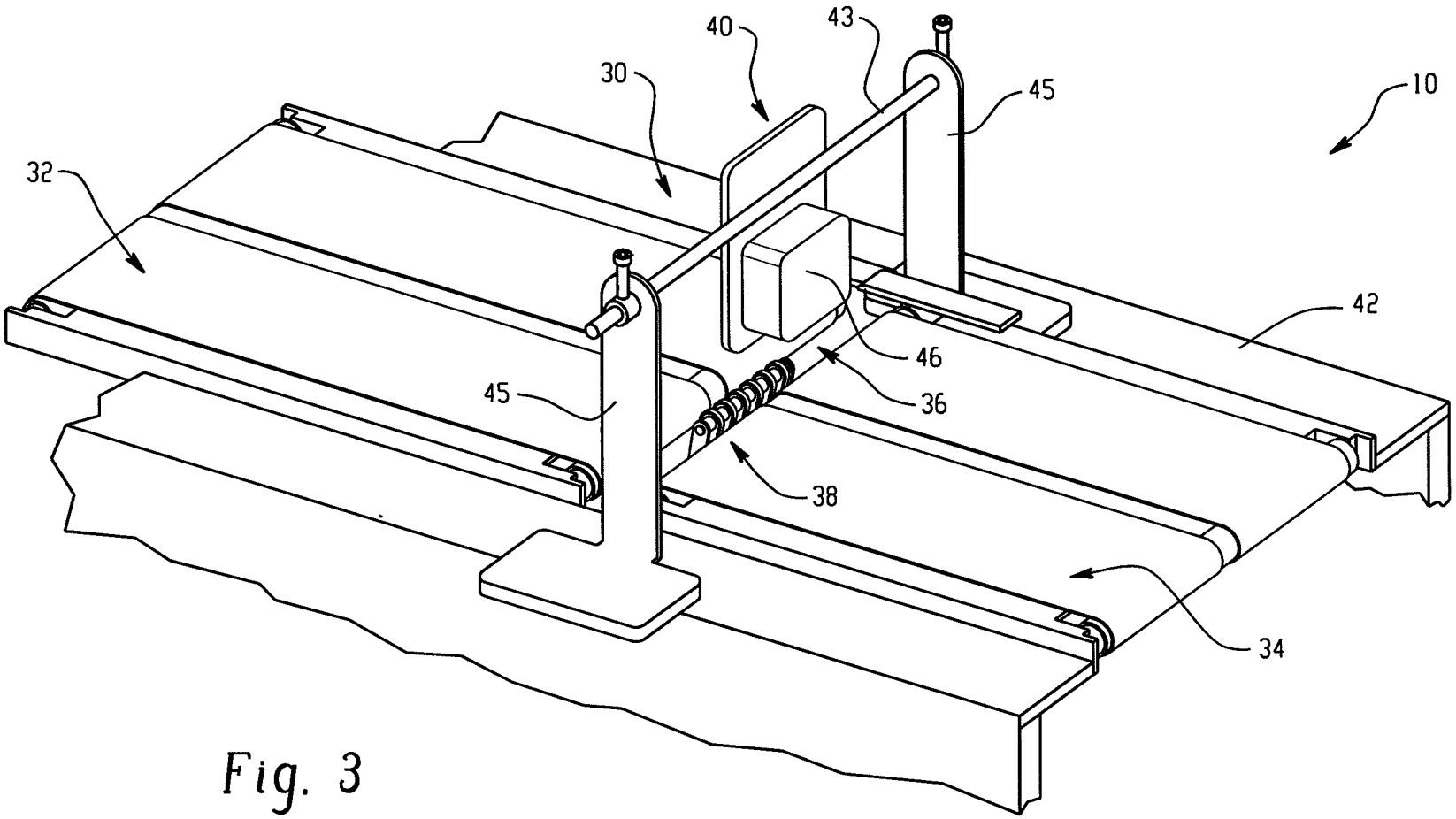
Figure 4:
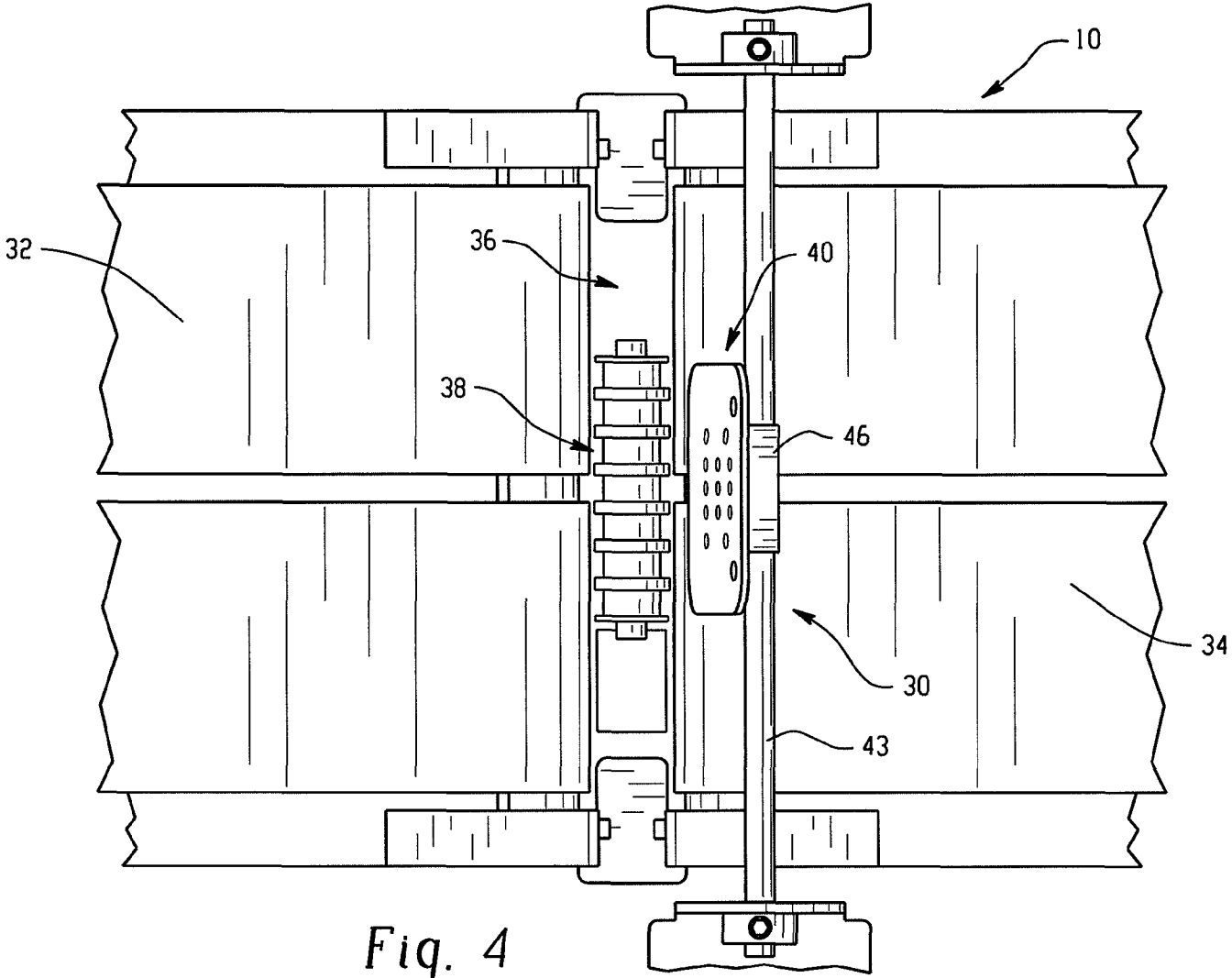

Referring to FIGS. 1, 3 and 4, labeling apparatus 10 includes a label applying section, generally referred to as element 30, that includes a first conveyor section 32 and a second conveyor section 34 aligned with the first conveyor section in a conveying direction to provide a conveying surface (e.g., a horizontal conveying surface) along which a product can travel. The first and second conveyor sections 32 and 34 are spaced apart from each other in the conveying direction thereby forming a gap 36 therebetween. Located between the first and second conveyor sections 32 and 34 is a vertically-oriented label conveyor assembly 38. Located above the conveying surface is a wiper assembly 40. The wiper assembly 40 is spaced vertically from the conveying surface to provide a space 42 through which the product can pass. The wiper assembly 40 is supported at its vertical position by a support rod 43, which may allow for some rotation of the wiper assembly. The support rod 43 is, in turn, supported by mount brackets 45 located at opposite sides of the conveying path and connected to frame 47 of the labelling apparatus. As will be described, the label conveyor assembly 38 feeds a leading edge of the wrap label 18 from beneath the conveying surface, upwardly through the gap 36 and onto the wiper assembly 40 with the wrap label spanning the space 42 to apply the wrap label 18 to the package.

Figure 5:
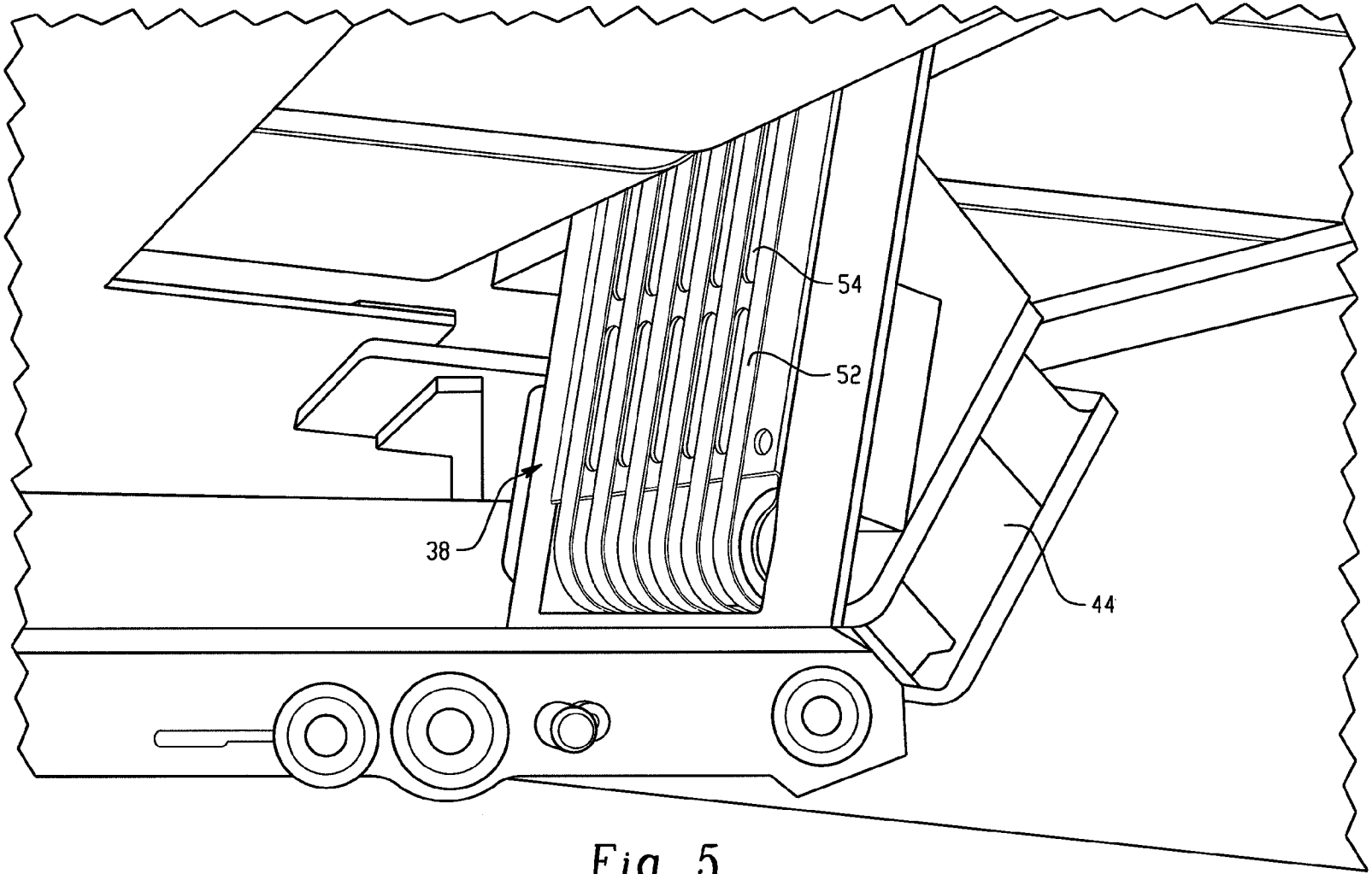
FIGS. 5 and 6 are images of an embodiment of a label conveyor apparatus for use in the label applying section of FIG. 1.

Referring also to FIG. 5, the label conveyor assembly 38 and the wiper assembly 40 each include respective vacuum assemblies 44 and 46. In some embodiments, the vacuum assemblies 44 and 46 include a fan that is used to draw a vacuum at label-engaging surfaces of the label conveyor assembly 38 and wiper assembly 40. Referring particularly to FIG. 1, in the illustrated embodiment, wiper assembly 40 includes a wiper 48 (e.g., in the form of a plate) that includes apertures 50 extending therethrough through which the associated fan can draw air. Referring now to FIG. 5, the label conveyor assembly 38 includes multiple, transversely spaced conveyor belts 52 between which the associated fan can draw air. A slotted plate 54 is located between the conveyor belts 52 and the associated fan.

Figure 6:
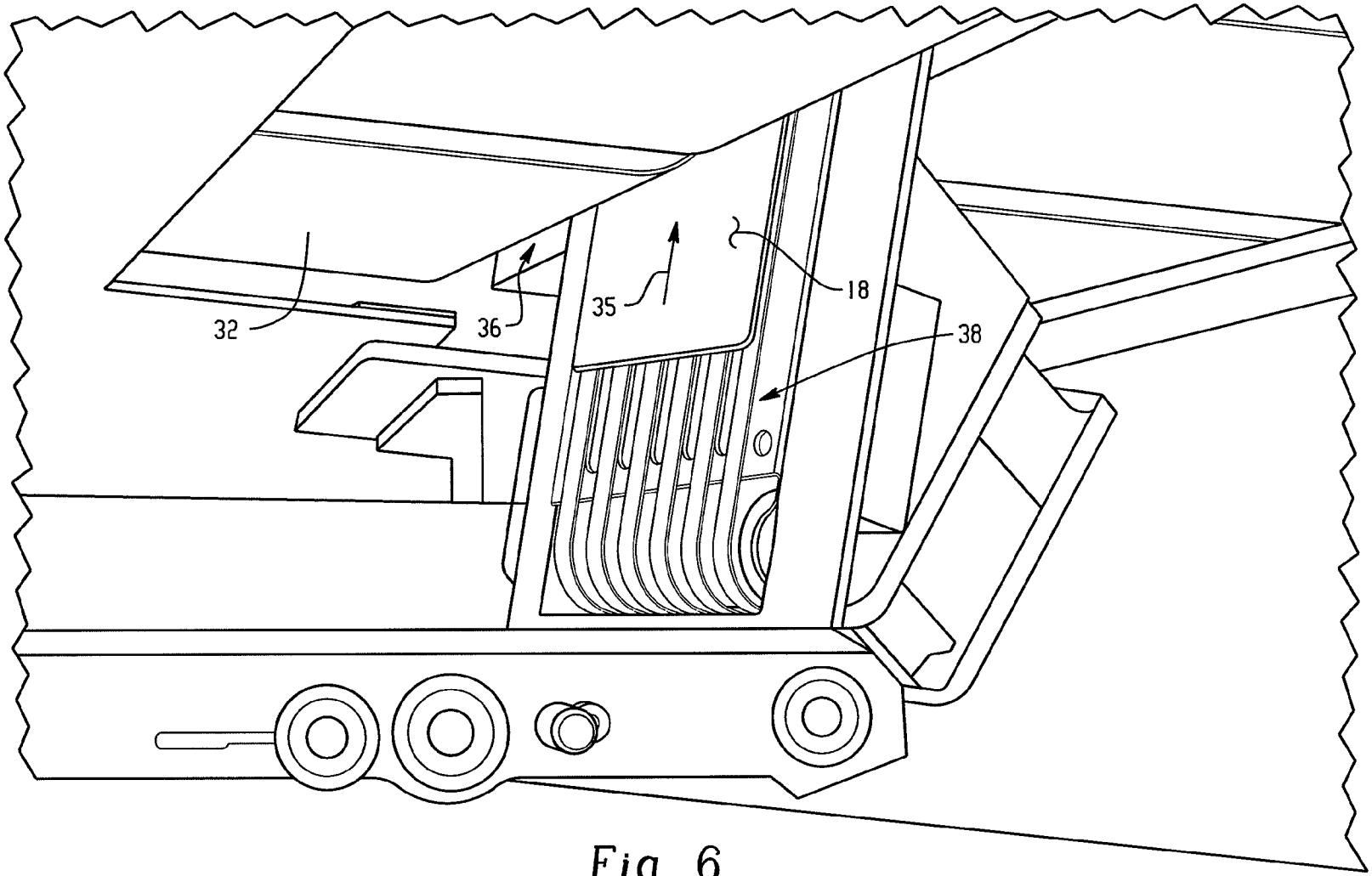

Referring now to FIG. 6, individual wrap labels 18 are fed onto the label conveyor assembly 38 with their adhesive sides facing away from the belt surfaces. With the fan of the label conveyor assembly 38 in operation, the non-adhesive side of the wrap label 18 is drawn onto the belt surfaces and the wrap label is conveyed upwardly in the direction of arrow 35 toward the conveying surface formed by the first and second conveyor sections 32 and 34. The vacuum may be drawn along nearly the entire length of the label conveyor assembly 38.

Figure 7:
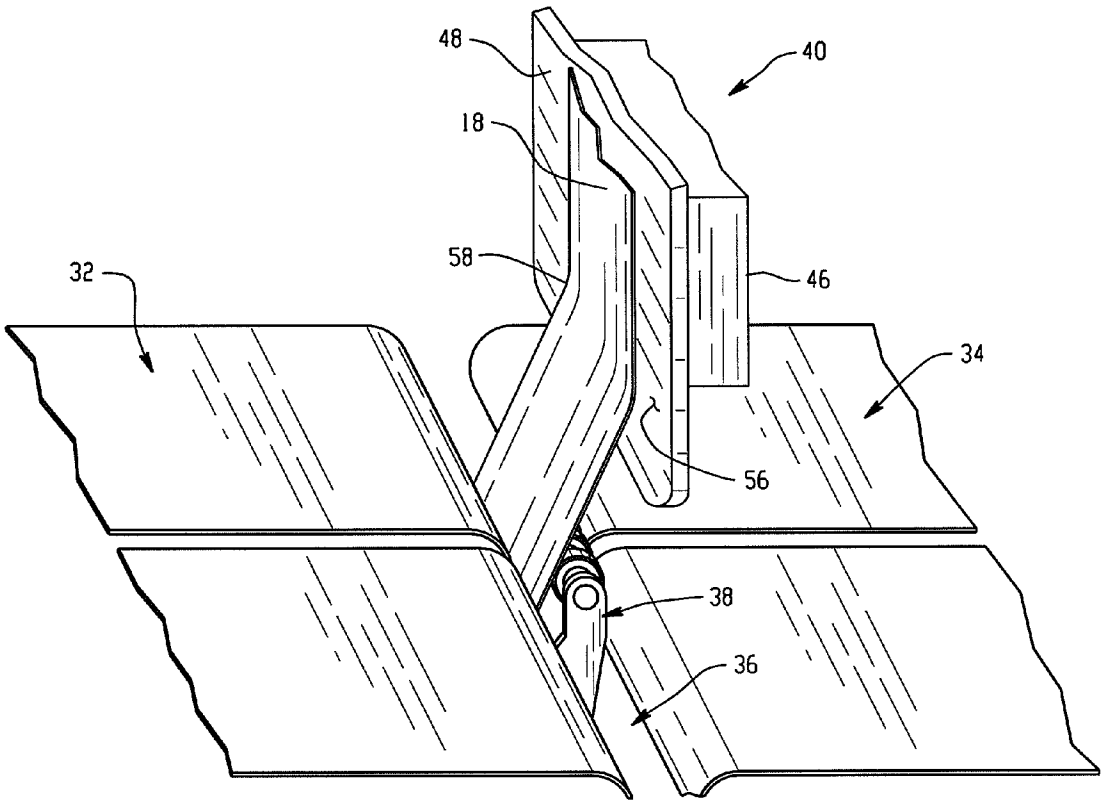
FIGS. 7-12 illustrate an embodiment of a method of applying a wrap label to a tray product using the label applying section of FIG. 1.

Referring to FIG. 7, the label conveyor assembly 38 operates such that it locates a leading end of the wrap label 18 onto an upstream-facing surface 56 of the wiper 48. With the fan of the wiper assembly 40 in operation, the non-adhesive side of the wrap label 18 is drawn onto the upstream-facing surface 56 of the wiper 48. Once the leading end of the wrap label 18 is in position, the conveyor assembly 38 stops moving the wrap label and the wrap label is held in the position illustrated by FIGS. 7 and 8 by the vacuum being drawn by the vacuum assemblies 44 and 46.

Figure 8:
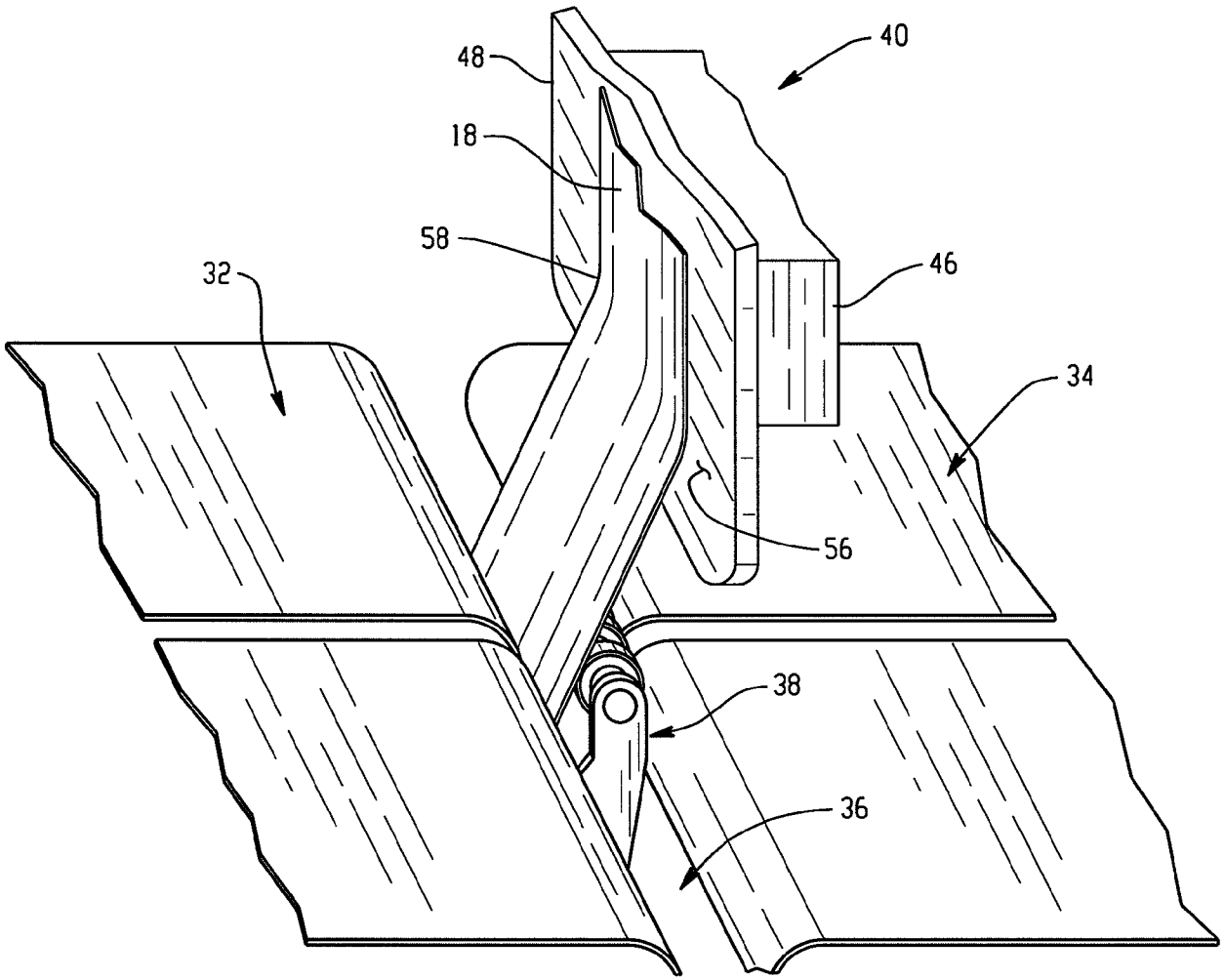

As can be seen by FIGS. 7 and 8, the wiper 48 is offset in the conveying direction from the belt surfaces of the label conveyor assembly 38. This offset creates a bend 58 in the wrap label 18. This bend 58 can be advantageous when applying the wrap label 18 to the product, particularly a tray or other low profile product by providing a region of the wrap label that conforms somewhat to an approaching product edge (e.g., see edge 20 of FIGS. 9 and 10). In some embodiments, the amount of wiper 48 offset relative to the label conveyor assembly 38 and/or the elevation of the wiper 48 relative to the product conveying surface is adjustable to accommodate products of different sizes and shapes.

Figure 9:
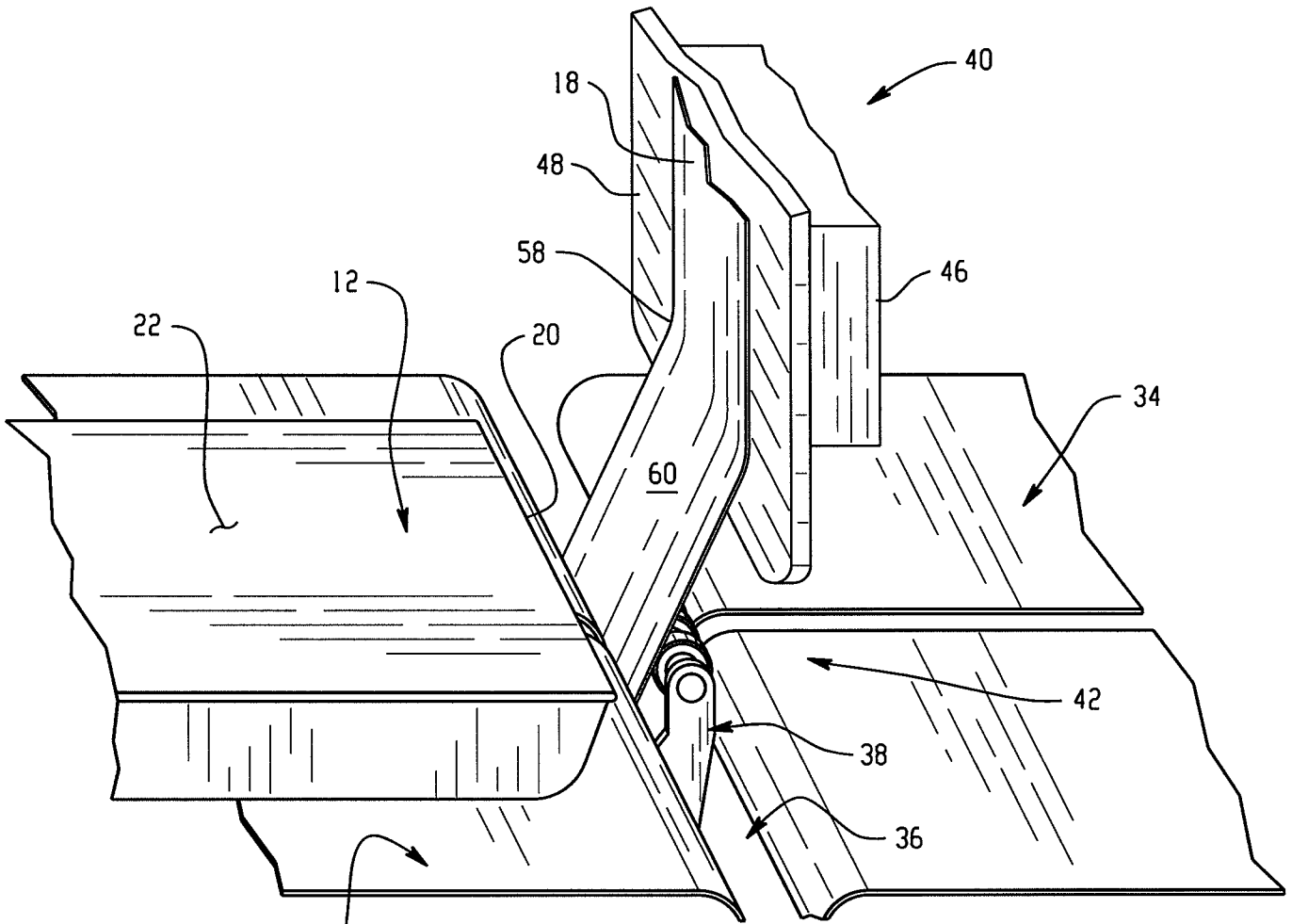
Figure 10:
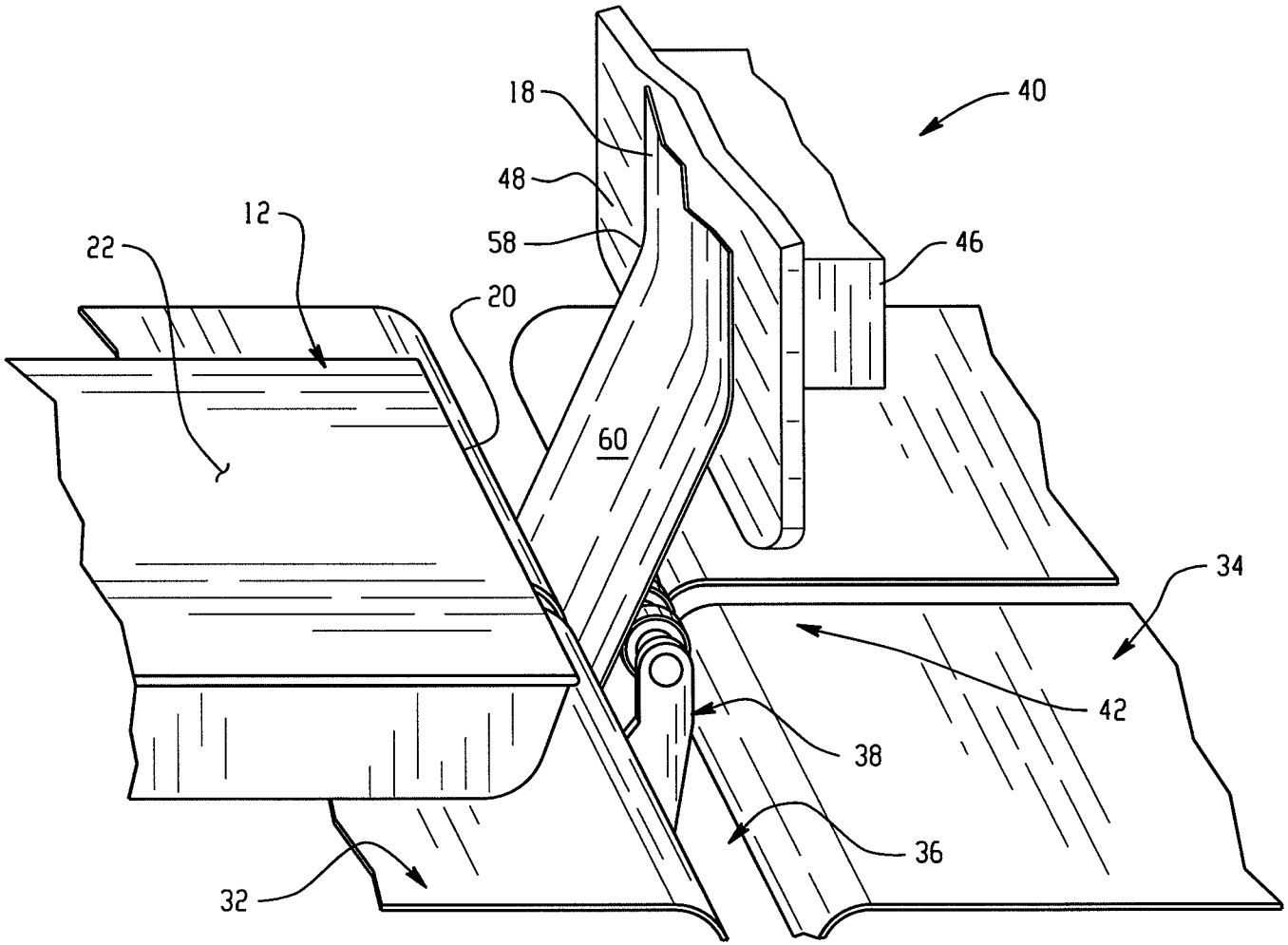
Figure 11:
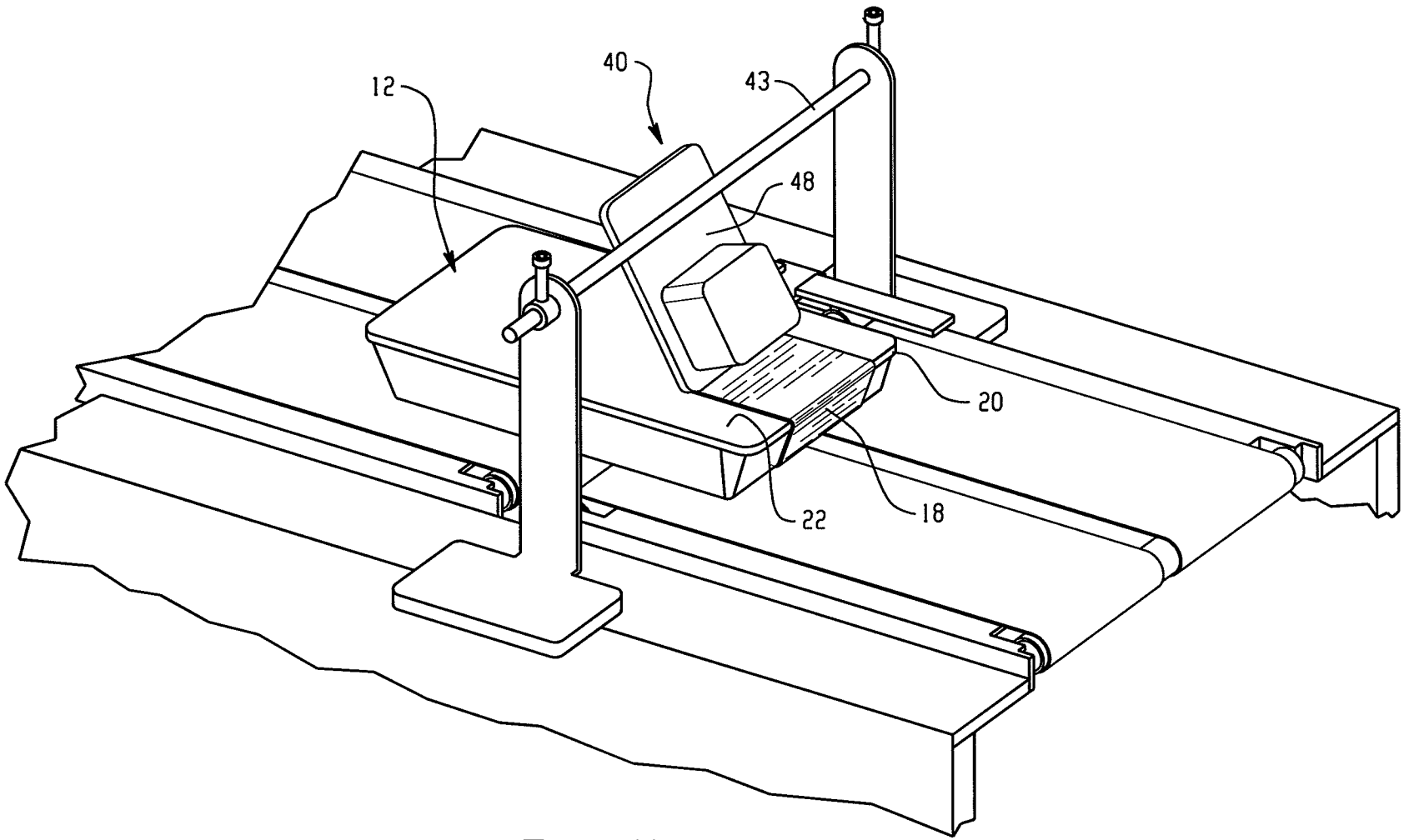
Figure 12:
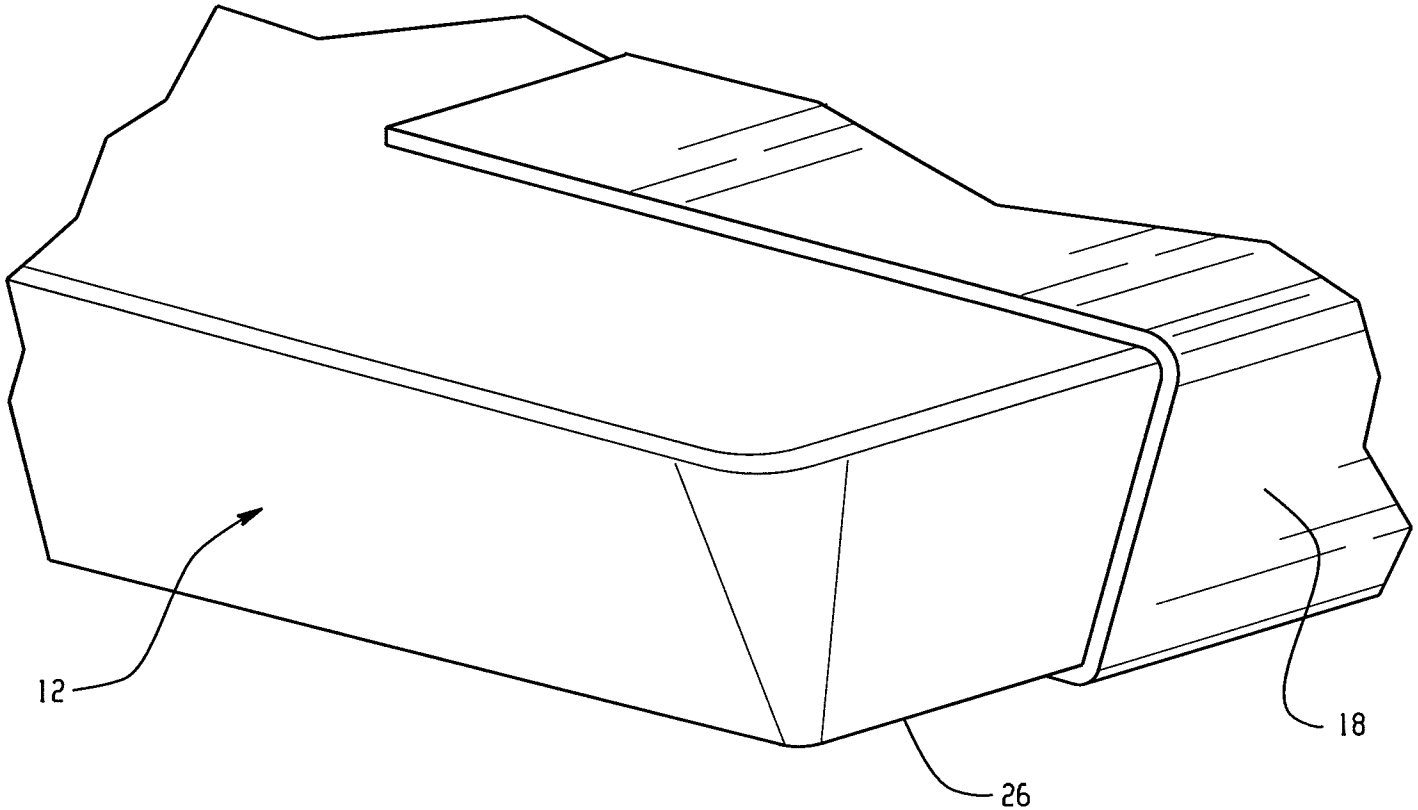

Referring to FIGS. 9 and 10, the first conveyor section 32 moves the tray product 12 toward the wrap label 18 with the adhesive surface 60 of the wrap label facing the tray product. As can be seen, the height of space 42 is less than a height of the tray product 12. For example, if the tray product 12 has a height of one inch, the height of the space 42 is less than one inch. Referring also to FIG. 11, this height arrangement allows the wiper 48 to wipe (apply pressure) against the wrap label 18 as it is applied to the top surface 22 of the tray product 12. Referring also to FIG. 12, the weight of the tray product 12 applies pressure to the wrap label 18 as it is applied to the bottom surface 26 of the tray product.

Figure 13:
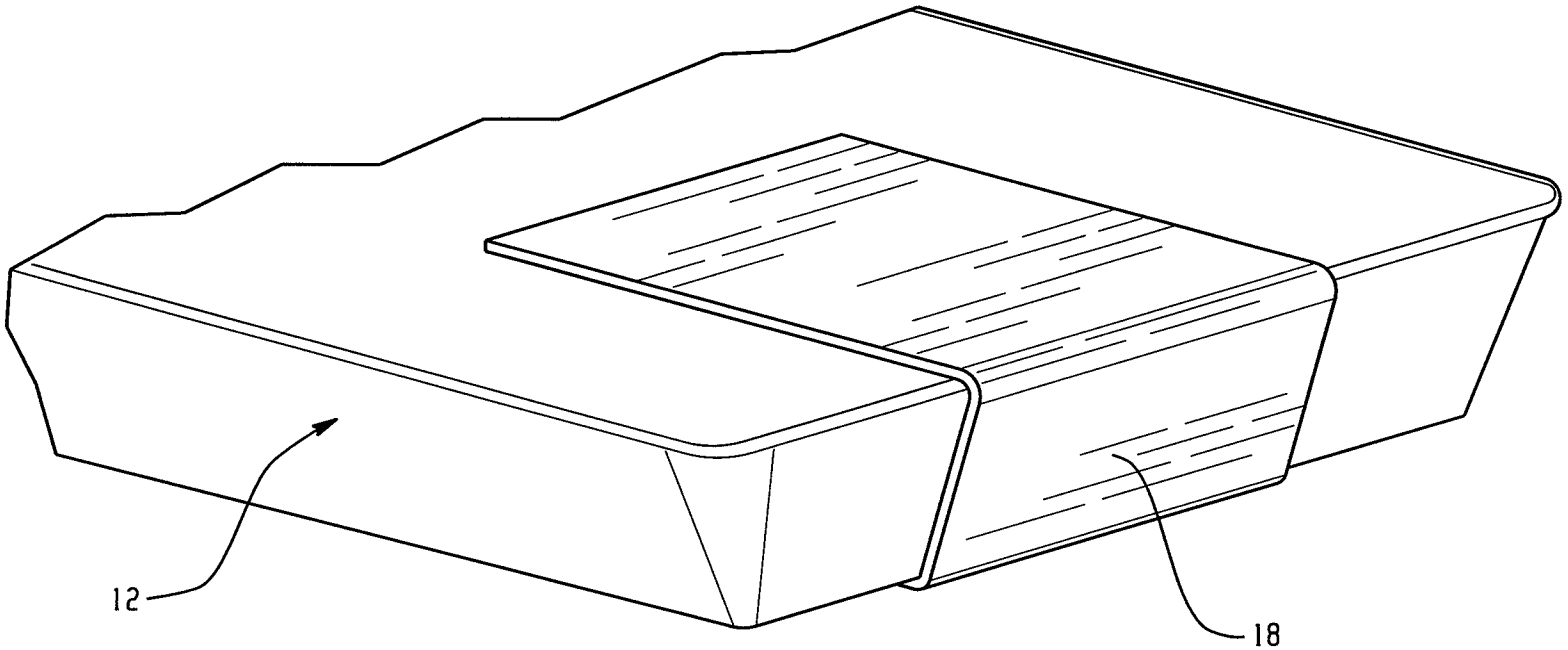
FIGS. 13 and 14 are images of an embodiment of a tray product including the wrap label.
Figure 14:
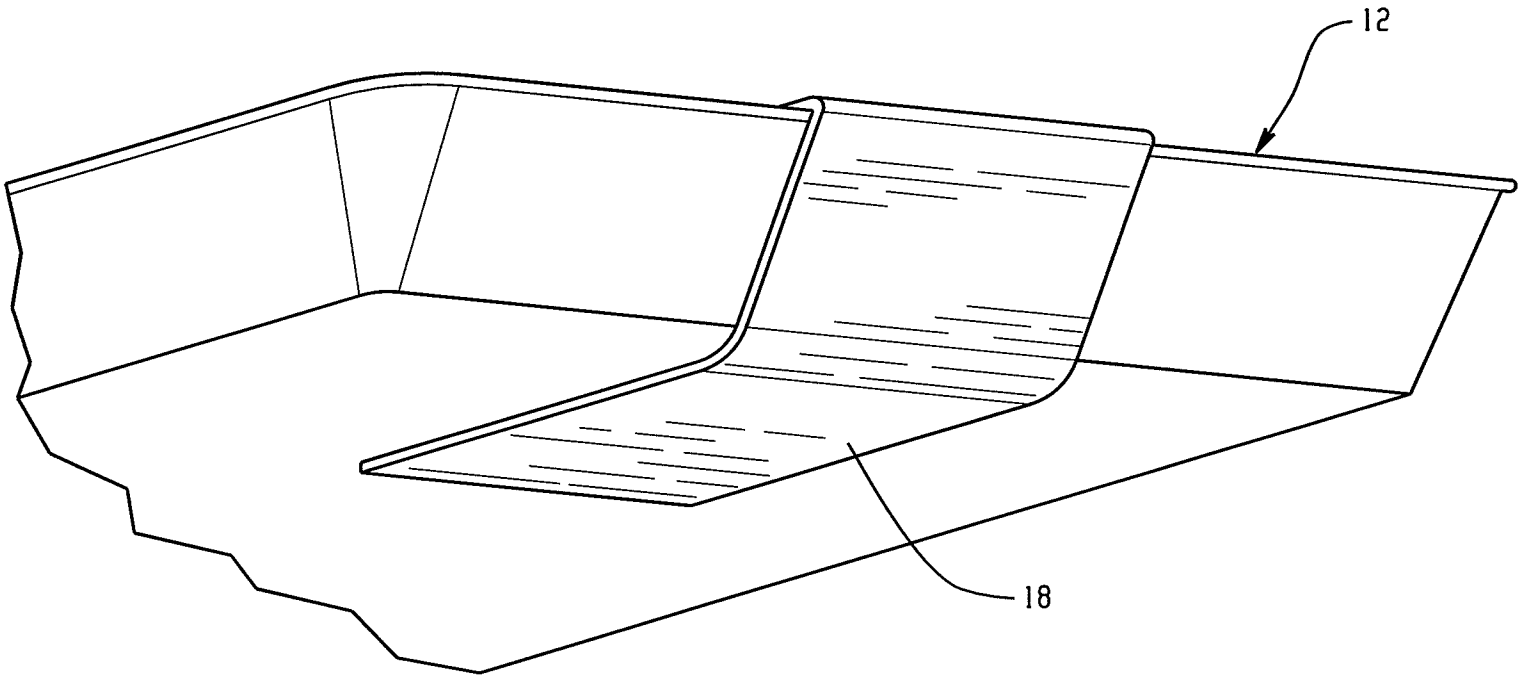

Referring to FIGS. 13 and 14, the above-described label applying section 30 enables taut application of the wrap label 18 to the tray product 12 thereby minimizing bulges and loops in the wrap label applied to the tray product. The bend 58, upper and lower fan assemblies 44, 46 and height arrangement between the wiper assembly 40 and the tray product 12 facilitates this taut application of the wrap label 18. In some embodiments, by delivering the wrap label 18 upwardly past the product conveying surface to the wiper assembly 40, improved adjustability of the position of the wiper assembly relative to the label conveyor assembly 38 can be achieved. The length of the wiper 48 can be increased or decreased to accommodate wrap labels 18 of differing lengths.

The individual wrap labels 18, for example, may be removed from a carrier sheet, die cut from label stock, etc. prior to their placement onto the label conveyor assembly 18. In some embodiments, the wrap labels 18 may include a print layer applied in an upstream process, either in line, or in a separate process. In some embodiments, the individual wrap labels 18 are provided from a printer that applies a print layer to the wrap labels. In some implementations, the label conveyor assembly 18 runs at a rate faster than the printer outputs the wrap labels such as at about 16 inches/sec to reduce printer jamming. The wrap labels 18 may be of any suitable length (e.g., about 10 inches) to adhere to both the top and bottom surfaces of the tray product 12. In one embodiment, the labeling apparatus 10 may also include a weighing station where the tray product 12 is weighed. This weight (along with other information) may be printed on the non-adhesive surface of the wrap label 18 prior to its application to the tray product 12.

In some implementations, such as where a tray product 12 includes a lid, for example, rather than a film wrapping, the wrap labels 18 can provide a barrier to opening the lid. The wrap labels 18 can also provide a tamper-evident barrier where the container is openable at the end that is wrapped over by the wrap label, such as clamshell-type packages.

A number of detailed embodiments have been described. Nevertheless, it will be understood that various modifications may be made.

What is claimed is:

1. A labeling apparatus for applying wrap labels, the labeling apparatus comprising:

a first conveyor section;

a second conveyor section aligned with the first conveyor section thereby defining a conveying surface along which a package is conveyed in a conveying direction, the first conveyor section being spaced from the second conveyor section in the conveying direction thereby defining a gap between the first conveyor section and the second conveyor section;

a label conveyor located at least partially below the conveying surface having a vertical orientation to define an upward wrap label feed path to deliver a wrap label upwardly through the gap between the first and second conveyor sections;

a wiper assembly located above and spaced vertically from the conveying surface to define a space between the wiper assembly and the conveying surface, the wiper assembly is arranged to receive a leading edge of the wrap label when it is delivered from the label conveyor and to position the leading edge of the wrap label such that the wrap label spans the space between the wiper assembly and the conveying surface for delivery of an adhesive surface of the wrap label over an edge of the package as the package passes through the space.

2. The labeling apparatus of claim 1, wherein the wiper assembly comprises:

a wiper plate having openings extending therethrough; and a vacuum assembly that draws air through the openings.

3. The labeling apparatus of claim 1, wherein the label conveyor comprises:

a plurality of conveyor belts spaced apart from each other in the cross-conveying direction; and a vacuum assembly that draws in air between the plurality of conveyor belts to position a trailing edge of the wrap label while the wrap label spans the space between the wiper assembly and the conveying surface.

4. The labeling apparatus of claim 1, wherein the wiper assembly is rotatably mounted to a support rod that extends across the conveying surface.

5. The labeling apparatus of claim 4, wherein a height of the space between the wiper assembly and the conveying surface is less than a height of the package being fed through the space between the wiper assembly and the conveying surface such that as the package is fed through the space between the wiper assembly and the conveying surface, the package engages a lower portion of the wiper assembly and the wiper assembly rotates as pressure is applied to the wrap label by the wiper assembly.

6. The labeling apparatus of claim 1, wherein a label engaging surface of the wiper assembly is offset in the conveyor direction from a label engaging surface of the label conveyor.

7. The labeling apparatus of claim 1 further comprising a wrap label having a leading edge located on the wiper assembly and a trailing edge located on the label conveyor such that the wrap label spans the space between the wiper assembly and the conveying surface for delivery of an adhesive surface of the wrap label over an edge of the package as it passes through the space.

8. A labeling apparatus for applying wrap labels, the labeling apparatus comprising:

a first conveyor section;

a second conveyor section aligned with the first conveyor section thereby defining a conveying surface along which a package is conveyed in a conveying direction, the first conveyor section being spaced from the second conveyor section in the conveying direction thereby defining a gap between the first conveyor section and the second conveyor section;

a label conveyor located at least partially below the conveying surface having a vertical orientation to deliver a wrap label upwardly through the gap between the first and second conveyor sections;

a wiper assembly located above and spaced vertically from the conveying surface to define a space between the wiper assembly and the conveying surface, the wiper assembly comprising a vacuum assembly configured to generate negative pressure to position a leading edge of the wrap label when it is delivered from the label conveyor such that the wrap label spans the space between the wiper assembly and the conveying surface for delivery of an adhesive surface of the wrap label over an edge of the package as the package passes through the space.

9. The labeling apparatus of claim 8, wherein the label conveyor comprises:

a plurality of conveyor belts spaced apart from each other in the cross-conveying direction; and a vacuum assembly that draws in air between the plurality of conveyor belts to position a trailing edge of the wrap label while the wrap label spans the space between the wiper assembly and the conveying surface.

10. The labeling apparatus of claim 8, wherein the wiper assembly is rotatably mounted to a support rod that extends across the conveying surface.

11. The labeling apparatus of claim 10, wherein a height of the space between the wiper assembly and the conveying surface is less than a height of the package being fed through the space between the wiper assembly and the conveying surface such that as the package is fed through the space between the wiper assembly and the conveying surface, the package engages a lower portion of the wiper assembly and the wiper assembly rotates as pressure is applied to the wrap label by the wiper assembly.

12. The labeling apparatus of claim 8, wherein a label engaging surface of the wiper assembly is offset in the conveyor direction from a label engaging surface of the label conveyor.

13. The labeling apparatus of claim 8 further comprising a wrap label having a leading edge located on the wiper assembly and a trailing edge located on the label conveyor such that the wrap label spans the space between the wiper assembly and the conveying surface for delivery of an adhesive surface of the wrap label over an edge of the package as it passes through the space.

14. A labeling apparatus for applying wrap labels, the labeling apparatus comprising:

a first conveyor belt section;

a second conveyor belt section aligned with the first conveyor belt section thereby defining a conveying surface along which a package is conveyed in a conveying direction, the first conveyor belt section spaced from the second conveyor belt section in the conveying direction thereby defining a gap between the first conveyor belt section and the second conveyor belt section;

a label conveyor located at least partially below the conveying surface, the label conveyor extending upwardly toward the gap between the first and second conveyor sections and defining an upwardly extending label conveying path, the label conveyor including a vacuum arrangement;

a wiper assembly rotatably mounted above and spaced vertically from the conveying surface to define a space between the wiper assembly and the conveying surface, the wiper assembly including a vacuum arrangement;

a wrap label having a leading edge held on the wiper assembly by the vacuum arrangement of the wiper assembly and a trailing edge held on the label conveyor by the vacuum arrangement of the label conveyor such that a free portion of the wrap label spans the space between the wiper assembly and the conveying surface, an adhesive surface of the wrap label facing the first conveyor belt section.

15. The labeling apparatus of claim 14, further comprising: a package supported on the first conveyor belt section and having a leading edge engaged with the adhesive surface of the wrap label.

16. The labeling apparatus of claim 15, wherein a label engaging surface of the wiper assembly is offset in the conveyor direction from a label engaging surface of the label conveyor.

* * * * *